US010975594B2

(12) United States Patent
Refior et al.

(10) Patent No.: US 10,975,594 B2
(45) Date of Patent: Apr. 13, 2021

(54) FENCEPOST REMOVAL TOOL

(71) Applicants: Gerry W. Refior, Pleasanton, NE (US); Daniel J. Refior, Pleasanton, NE (US)

(72) Inventors: Gerry W. Refior, Pleasanton, NE (US); Daniel J. Refior, Pleasanton, NE (US)

( * ) Notice: Subject to any disclaimer, the term of this patent is extended or adjusted under 35 U.S.C. 154(b) by 57 days.

(21) Appl. No.: 16/165,867

(22) Filed: Oct. 19, 2018

(65) Prior Publication Data

US 2019/0257113 A1 Aug. 22, 2019

Related U.S. Application Data

(60) Provisional application No. 62/575,041, filed on Oct. 20, 2017.

(51) Int. Cl.

| | |
|---|---|
| ***E04H 17/26*** | (2006.01) |
| ***B25B 7/06*** | (2006.01) |
| ***B25B 9/00*** | (2006.01) |
| ***B25B 33/00*** | (2006.01) |
| ***B25C 11/00*** | (2006.01) |

(52) U.S. Cl.

CPC ..... *E04H 17/265* (2013.01); *B25B 7/06* (2013.01); *B25B 9/00* (2013.01); *B25B 33/00* (2013.01); *B25C 11/00* (2013.01)

(58) Field of Classification Search

CPC .. B25B 33/00; B25B 7/00; B25B 7/02; B25B 7/06; B25B 7/12; B25B 9/00; B25C 11/00; B25C 11/02; E21B 11/005; E04H 17/265; A01G 17/16

See application file for complete search history.

(56) References Cited

U.S. PATENT DOCUMENTS 188,133 A * 3/1877 Hellwig ..... B26B 17/02 30/191
397,383 A * 2/1889 Nivison ..... A01B 1/18 294/50.8
1,393,026 A * 10/1921 Kepler ..... B25C 11/02 29/267
1,405,339 A * 1/1922 Schoonover ..... B25C 11/00 254/21
1,986,191 A * 1/1935 Evans ..... B25C 11/02 254/28
2,568,641 A * 9/1951 Kramer ..... B25B 7/18 81/349
2,643,564 A * 6/1953 Klein ..... B25B 7/12 81/314
2,710,765 A * 6/1955 Arens ..... E21B 11/005 294/50.6
2,735,712 A * 2/1956 Hart ..... E21B 11/005 294/50.5
2,838,972 A * 6/1958 Heald ..... B25B 7/12 81/339
4,042,270 A * 8/1977 Weiland ..... E21B 11/005 294/50.8

(Continued)

*Primary Examiner* — Tyrone V Hall, Jr.

(74) *Attorney, Agent, or Firm* — Kutak Rock LLP; Brian L. Main

(57) ABSTRACT

A fence post removal tool may include first and second arms, each of the arms having a handle and a working portion. At least one coupling member is pivotally coupled to each of the working portions. An opening defined by engagement surfaces provided in opposing faces of each of the working portions is provided and is configured to engage the surface of a fence post when in use.

16 Claims, 6 Drawing Sheets

(56) References Cited

U.S. PATENT DOCUMENTS

| | | | | | |
|---|---|---|---|---|---|
| 4,545,234 | A * | 10/1985 | Schnellmann | B25B 7/12 | 30/193 |
| 5,273,331 | A * | 12/1993 | Burnham | A01C 5/02 | 294/50.8 |
| 5,544,416 | A * | 8/1996 | Lin | B26B 17/02 | 30/193 |
| 5,611,519 | A * | 3/1997 | Garcia | B25B 7/02 | 254/22 |
| 5,735,031 | A * | 4/1998 | Johnson | B25B 7/02 | 29/235 |
| 5,743,579 | A * | 4/1998 | Ranburger | A01B 1/00 | 294/50.8 |
| 6,443,515 | B1 * | 9/2002 | Wu | B25B 13/10 | 269/282 |
| 7,603,884 | B1 * | 10/2009 | Michrina | B25B 7/02 | 72/409.01 |
| 2015/0158188 | A1 * | 6/2015 | Chang | B26B 17/02 | 30/123 |
| 2015/0240519 | A1 * | 8/2015 | Johnstone | B25B 25/00 | 7/117 |

* cited by examiner

FENCEPOST REMOVAL TOOL

BACKGROUND

Agricultural crop fields have long been used for grazing cattle and other livestock during portions of the year. Typically after harvest, grain or seed loss from corn or soybeans may be left behind by combines or other harvesting equipment that cannot recover 100% of the available crop. This is often the case in fields used for corn and soybeans.

To avoid waste of such crops, cattle or other livestock may be introduced to the fields for a period of time after harvest. The animals consume the crop left in the field and, in the case of corn and some other crops, stover as well. This reduces waste and increases total economic output from the fields.

However, such fields may not always be fenced with fences suitable to restrain the livestock. Further, when fencing is present, it is typically positioned around the utmost perimeter of a property and may include stationary equipment, culverts, creeks, dwellings, storage structures, or other areas access to which should be restricted for the livestock to avoid damage to the structures and areas or injury to the animals. A fairly common solution to this problem is to temporarily install supplemental fencing.

Typical fencing for such uses, such as single and double wire electric fences, include fenceposts for supporting wires or other fencing materials. These posts are typically of a relatively small diameter to facilitate their placement into the ground. When placed after harvest, the posts may be able to be relatively easily driven into the ground. In some situations, hammers, post drivers, or other device may be used.

Another issue with the use of such fences is that they must be removed after the livestock is removed and before the field is planted for the following season. However, the ground may be particularly hard, dry, or frozen at this time as it is before spring planting. The result is that it may be very difficult for an individual to remove the posts from the ground.

Accordingly, there is a need for a tool to facilitate removal of fenceposts from the ground. Additionally, in cases where removal is particularly difficult, there is a need for an assisting device that can further assist in the removal of the posts from the ground. Further, there is a need for a kit including both a tool and assisting device that may be utilized as needed by a user for removal of fenceposts from the ground.

DETAILED DESCRIPTION

Figure 1:
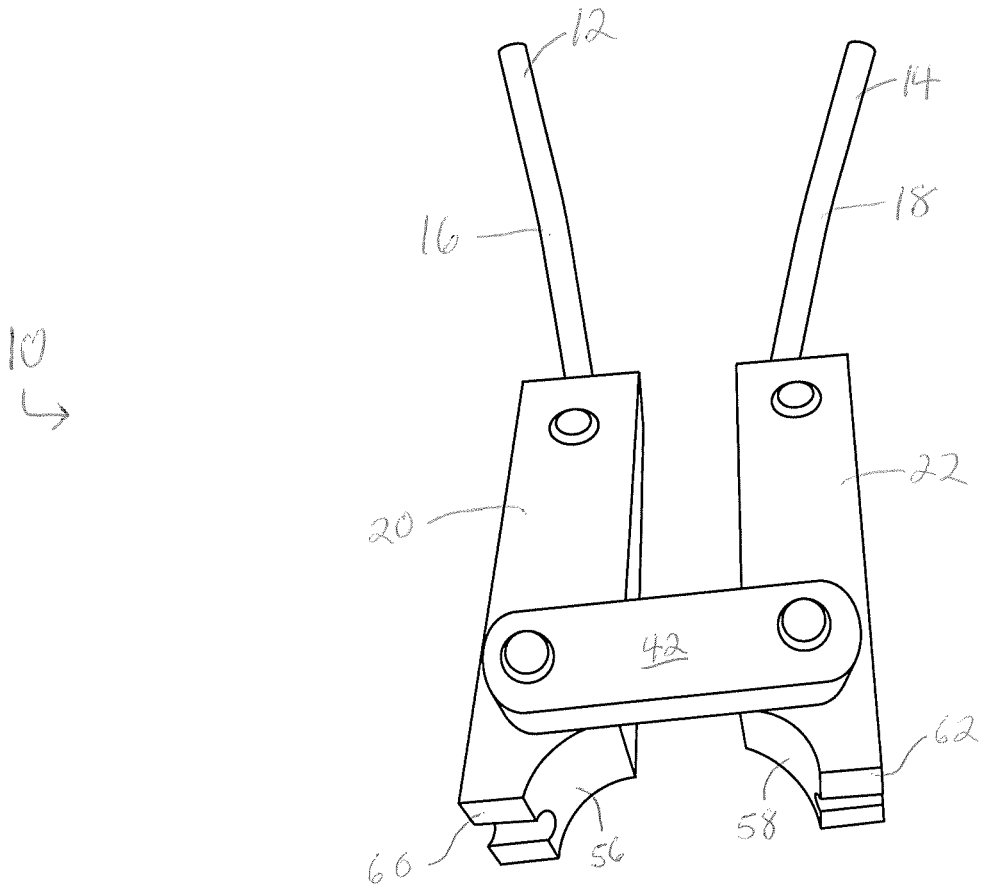
FIG. 1 is a perspective view of a fencepost removal tool.
Figure 2:
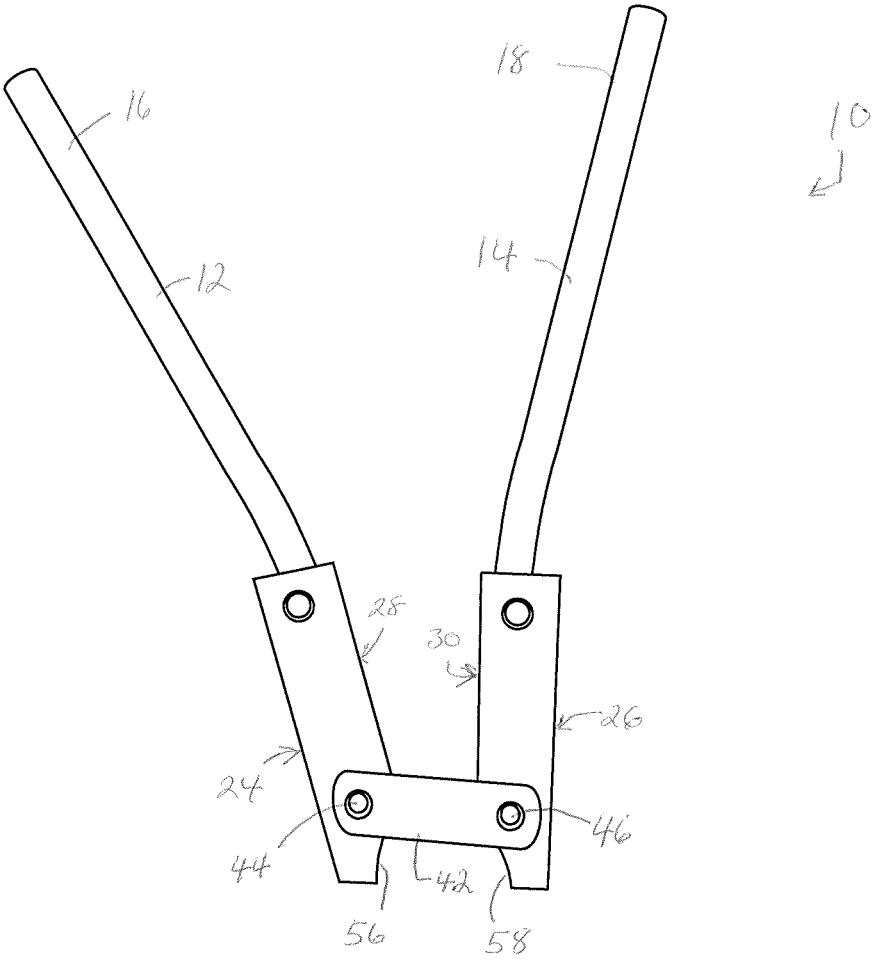
FIG. 2 is a side, elevation view of the fencepost removal tool of FIG. 1.
Figure 3:
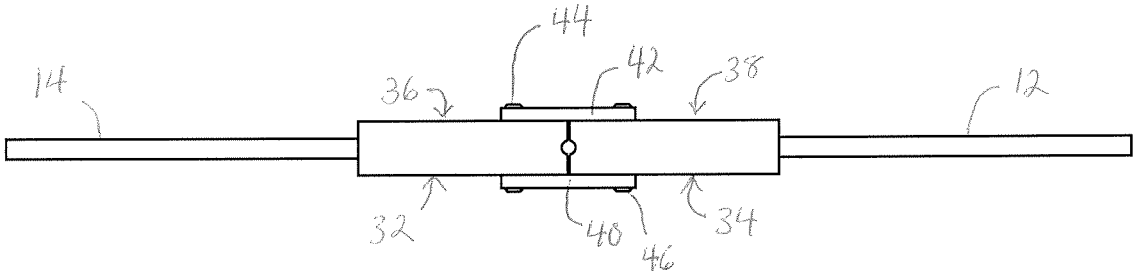
FIG. 3 is a top, elevation view of the fencepost removal tool of FIG. 1.
Figure 4:
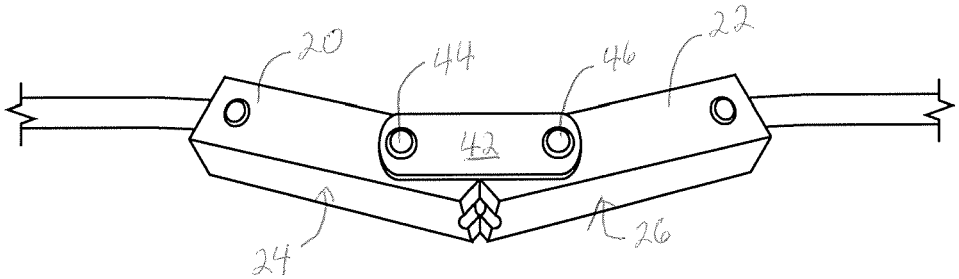
FIG. 4 is another perspective view of the fencepost removal tool of FIG. 1.
Figure 5:
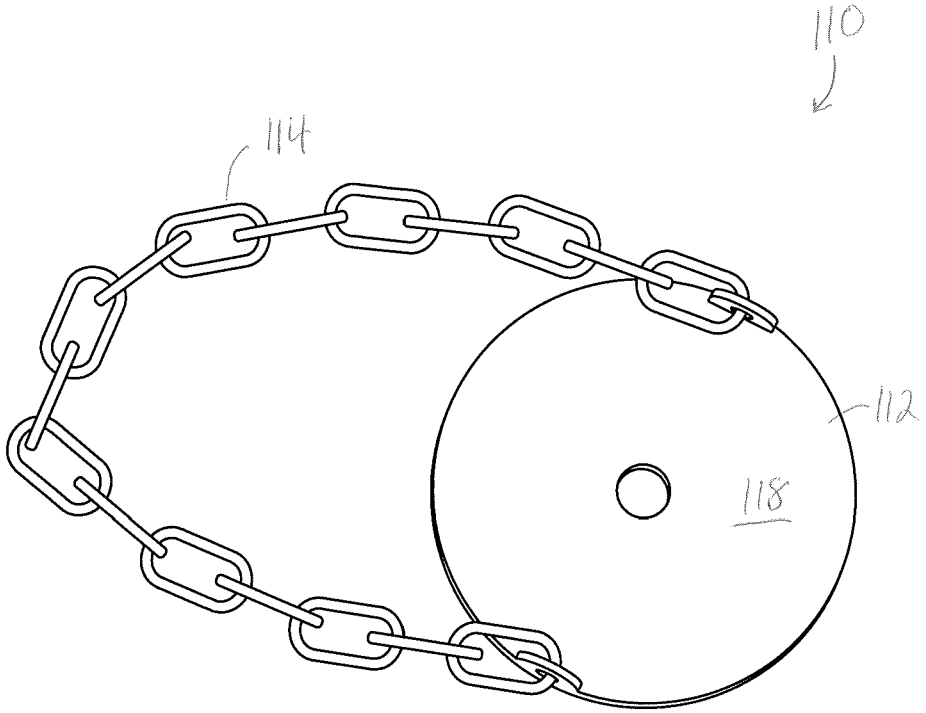
FIG. 5 is a perspective view of an assisting device for use with the fencepost removal tool of FIG. 1.
Figure 6:
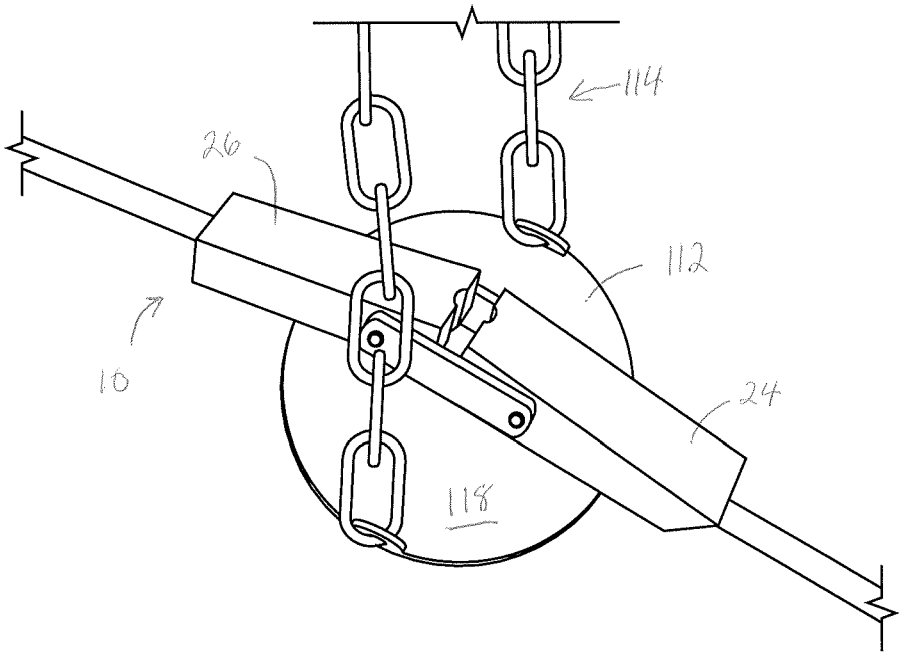
FIG. 6 is a perspective view of the fencepost removal tool of FIG. 1 in combination with the assisting device of FIG. 5.

A fencepost tool 10 may generally include a first arm 12 and a second arm 14. Each of the first and second arms 12 and 14 may include a handle 16 and 18, respectively, and working portions 20 and 22, respectively. Each of working portions 20 and 22 may include a top surface 24 and 26, respectively, a bottom surface, 28 and 30, a front surface 32 and 34, respectively, and a back surface 36 and 38, respectively. Working portions 20 and 22 are shown as generally elongated structures positioned relative to each other such that they align along a common axis and coupled to the respective handle with which they form an arm at ends distal to one another.

First arm 12 and second arm 14 may be coupled by links 40 and 42. Links 40 and 42 are shown as coupled at axes of rotation about which working portions 20 and 22 may pivot. The axes of rotation are generally parallel to each other and extend from the front surfaces 32 and 34 through back surfaces 36 and 38, respectively. Links 40 and 42 are generally shown as oval plates with openings configured to align with apertures through working portions 20 and 22 in-line with the axes of rotation. Fasteners 44 and 46 may be utilized to couple first arm 12 and second arm 14. Fasteners 44 and 46 are shown as clevis pins passing through link 40, one of working portions 20 or 22 and through link 42. Fasteners 44 and 46 may be retained by locking elements such as cotter pins.

Working portions 20 and 22 include faces 52 and 54 which oppose each other and on each arm 12 and 14 and are positioned distal to the positions at which working portions 20 and 22 are coupled to handles 16 and 18, respectively. One or both of working portions include a recess along an edge where such working portions face meats such working portions bottom surface. The recesses 56 and 58 are shown with both of working portions 20 and 22, respectively, and extend from front surface 32 or 34 to back surface 36 or 38. Recesses 56 and 58 prevent interference from material preventing movement of first arm 12 and second arm 14 relative to each other whereby fencepost tool 10 may be transitioned from an open position to a closed position and vice versa.

Working portions 20 and 22 further include engagement surfaces 60 and 62. When fencepost tool 10 is in a closed position, engagement surfaces may form an opening through which a fencepost may be received. The opening may be sized such that it is slightly smaller than the cross-sectional dimensions of the fencepost. Such a configuration allows fencepost tool 10 to be positioned over a top of the fencepost with the fencepost tool 10 in the open position and moved downwardly. At a desired height above the base of the fencepost, fencepost tool 10 may be transitioned to a closed, or nearly closed, position such that the engagement surfaces 60 and 62 come into contact with an exterior surface of the fencepost.

In use, a user may transition fencepost tool 10 to the closed, or nearly closed, position by moving the handles 16 and 18 upwardly to a point at which engagement surfaces 60 and 62 contact the fencepost. At this point, the fencepost will interfere with further closing of fencepost tool 10 and further force directed upwardly on handles 16 and 18 will be transferred to the post and effect removal of the fencepost from the ground.

In some situations, such as when the fencepost to be removed is in particularly hard, dry, or frozen ground, it may be advantageous to facilitate application of greater upward force to fencepost tool 10 when it is closed on a fencepost to be removed. Assisting device 110 may be used in conjunction with fence tool 10 in such situations. Assisting device 110 includes a bearing portion 112 shown as plate. While shown as circular, bearing portion 112 may be of any suitable geometry including, but not limited to square, rectangular, or polygonal. A tensile member 114 may be provided and is shown as chain. Tensile member 114 is coupled to bearing portion 112 at opposing sides of bearing portion 112. Alternatively, multiple tensile members may be used, or configured to be coupled to bearing portion 112 at more than two positions. Bearing portion 112 includes an aperture 116 which is configured to receive a fencepost.

When used, assisting device 110 may be passed over the top of the fencepost and lowered towards the ground or even dropped to the ground with the fencepost passing through aperture 116. Fencepost tool 10 is then positioned over a top of the fencepost with the fencepost tool 10 in the open position and moved downwardly. At a desired height above the base of the fencepost, fencepost tool 10 may be transitioned to a closed, or nearly closed, position such that the engagement surfaces 60 and 62 come into contact with an exterior surface of the fencepost. Alternatively, fencepost tool 10 may be lowered proximate to the level of bearing portion 112, transitioned to a nearly open position, and rested on a top surface 118 of bearing portion 112.

In some embodiments, a flexible material such as an elastomer may be provided. Such material may be positioned in the opening to provide an engagement surface and allow a single tool to be utilized with posts of various sizes. Additionally, the working portions may be adjustable by screws coupled to the face surfaces allowing the size of the opening to be adjusted.

A mechanized lift, such as a backhoe, forklift, or similar machine may engage tensile member 114 by putting a tine of the forklift, backhoe or other device through the loop defined by bearing portion 112 and tensile member 114. When the mechanized lift is raised, slack in tensile member 114 (if any) may be taken up. The tension then exerted through tensile member 114 translates to an upward force on bearing portion 112 and, thereby, to the bottom surfaces 28 and 30 of working portions 20 and 22. This biases fencepost tool 10 into a closed, or nearly closed position such that engagement surfaces 60 and 62 contact the outer surface of the fencepost and translate the upward force to the fencepost and thus remove it from the ground. In other embodiments where a mechanized lift is not available or otherwise practical, a pulley system or other device for creating mechanical advantage may be utilized with assisting device 110 to facilitate removal of a fencepost from hard, dry, or frozen ground.

While specifically applicable to the removal of fenceposts from the ground, fencepost tool 10 may be used independently, or in conjunction with assisting device 110 to remove other devices from the ground. Similarly, rebar or other tensile components may be engaged to apply a tensile force while prefabricating concrete structures. Similarly, other applications can be envisioned where the mechanical advantage made possible through use of the tool, with or without the assisting device, may be used to apply a force to an object in an upward or other direction to facilitate removal, displacement, or achieve some other objective.

In some embodiments, a kit may be provided having both a fencepost tool 10 and an assisting device 110.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A fence post removal tool comprising:

first and second arms, each of such arms having a handle and a working portion extending therefrom; and at least one coupling member pivotally coupled to each of the working portions, wherein an opening defined by engagement surfaces provided in opposing faces of each of the working portions is configured to engage an outer surface of a fence post when in use, and wherein the first and second arms are positioned entirely on respective first and second sides of the removal tool.

2. The removal tool of claim 1, wherein the removal tool is moveable between an open configuration and a closed configuration, wherein moving the removal tool towards the closed configuration comprises rotating the first handle away from the second handle.

3. The removal tool of claim 1, wherein the first and second arms pivot about respective first and second pivot axes and wherein the opening is configured such that the fence post is perpendicular to the first and second pivot axes.

4. The removal tool of claim 3, wherein each working portion comprises a first portion extending between the respective handle and pivot axis and a second portion extending from the first portion away from the respective pivot axis, each engagement surface being defined by a distal end of the second portion of the respective working portion.

5. The removal tool of claim 4, wherein the removal tool is moveable from a disengaged configuration to an engaged configuration by rotating the engagement surfaces towards the fence post until each engagement surface engages with the fence post.

6. The removal tool of claim 5, wherein moving the removal tool to the engaged configuration comprises rotating the first handle away from the second handle.

7. The removal tool of claim 6, wherein biasing the removal tool towards the engaged configuration causes the biasing tool to clamp down on the fence post, thereby facilitating removal of the fence post by exerting an upward force upon the first and second arms of the removal tool.

8. The removal tool of claim 7, further comprising a biasing member for exerting an upward force upon the first and second arms of the removal tool, the biasing member being configured to engage with a bottom surface of each working portion.

9. The removal tool of claim 8, wherein the biasing member defines an aperture and a flat top surface, wherein the aperture is configured to receive the fence post and wherein the flat top surface is configured to engage with the bottom surface of each working portion.

10. The removal tool of claim 9, further comprising a tensile member extending from opposed edges of the biasing member, the tensile member being configured to facilitate exerting an upward force upon the first and second arms of the removal tool by way of the biasing member.

11. A clamping system for removing a fence post, the clamping system having a clamping mechanism comprising:

first and second working portions extending from first and second arms wherein the first and second arms are positioned entirely on respective first and second sides of the removal tool; and a first coupling member pivotally coupled to each of the first and second working portions such that the clamping mechanism is moveable between an open configuration and a closed configuration, wherein the first and second working portions define respective first and second engagement surfaces, the first engagement surface being displaced from the second engagement surface when the clamping mechanism is in the open configuration such that the clamping mechanism can be moved along a length of the fence post while the fence post is positioned between the first and second engagement surfaces, wherein moving the clamping mechanism from the open configuration towards the closed configuration causes the first and second engagement feature to move towards each other until each engages with an outer surface of the fence post, thereby moving the clamping mechanism from a disengaged configuration to an engaged configuration, and wherein biasing the clamping mechanism towards the closed configuration when it is in the engaged configuration causes the clamping mechanism to clamp down on the fence post.

12. The clamping system of claim 11, wherein the first and second working portions each comprise first and second portions positioned on either side of a respective first and second pivot axis, each engagement surface being defined by a distal end of the second portion of the respective working portion.

13. The clamping system of claim 12, wherein each of the first and second axes is perpendicular to the fence post.

14. The clamping system of claim 12, further comprising a biasing member for exerting an upward force upon the first and second working portions of the clamping mechanism, the biasing member being configured to engage with a bottom surface of each working portion.

15. The clamping system of claim 14, wherein the biasing member defines an aperture and a flat top surface, wherein the aperture is configured to receive the fence post and wherein the flat top surface is configured to engage with the bottom surface of each working portion.

16. The clamping system of claim 15, further comprising a tensile member extending from opposed edges of the biasing member, the tensile member being configured to facilitate exerting an upward force upon the first and second arms of the removal tool by way of the biasing member.

* * * * *